United States Patent [19]

Baxstrom

[11] Patent Number: 4,915,387

[45] Date of Patent: Apr. 10, 1990

[54] GOLF PRACTICE AND TRAINING DEVICE

[75] Inventor: Gary D. Baxstrom, Aurora, Colo.

[73] Assignee: Bax-Go, Inc., Denver, Colo.

[21] Appl. No.: 278,794

[22] Filed: Nov. 30, 1988

Related U.S. Application Data

[63] Continuation-in-part of Ser. No. 89, Jan. 2, 1987, abandoned.

[51] Int. Cl.[4] ..... A63B 69/36

[52] U.S. Cl. ..... 273/187 A

[58] Field of Search ..... 273/187 R, 187 A, 187 B, 273/183 A; 434/252

[56] References Cited

U.S. PATENT DOCUMENTS

| | | | |
|---|---|---|---|
| 1,484,390 | 2/1924 | Gibbs et al. | 273/187 A |
| 2,707,638 | 5/1955 | Manley | 273/187 A |
| 2,777,697 | 1/1957 | Crossot | 273/187 R |
| 2,941,808 | 6/1960 | Smith et al. | 273/187 R |
| 3,510,135 | 5/1970 | Gentile | 273/187 R |
| 3,542,369 | 11/1970 | Anderson | 273/187 R |
| 3,868,109 | 2/1975 | Fowler | 273/187 A |
| 3,868,116 | 2/1975 | Ford et al. | 273/186 C |
| 4,000,905 | 1/1977 | Shirhall | 273/187 A |
| 4,023,810 | 5/1977 | Lorang | 273/186 C |
| 4,095,797 | 6/1978 | Breese | 273/186 C |
| 4,101,130 | 7/1978 | Richards | 273/187 A |
| 4,146,231 | 3/1979 | Merkle et al. | 273/187 R |
| 4,164,352 | 8/1979 | O'Brien | 273/187 A |
| 4,248,431 | 2/1981 | Burnes | 273/187 R |
| 4,257,608 | 3/1981 | Funk | 273/187 R |
| 4,322,084 | 3/1982 | Reece et al. | 273/187 R |
| 4,354,683 | 10/1982 | Wooland | 273/187 R |
| 4,355,810 | 10/1982 | Rydeck | 273/186 C |
| 4,415,159 | 11/1983 | Matheny et al. | 273/187 A |
| 4,434,983 | 3/1984 | Taggart | 273/187 R |
| 4,538,815 | 9/1985 | Poirier | 273/187 R |
| 4,545,581 | 10/1985 | Williamson | 273/187 A |

*Primary Examiner*—George J. Marlo
*Attorney, Agent, or Firm*—John E. Reilly

[57] ABSTRACT

A golf practice mat has an upper surface provided with fixed lines to establish foot and shoulder alignment, swing path guidelines, ball position and unlofting lines in further combination with ball placement markers. Foot position indicia are color-coded to match up with ball placement markers (42) and line-of-flight arrows (38) to promote proper address and body position with respect to the ball thereby aiding a golfer's shot-making ability. The shoulder alignment (26) is closely spaced and parallel to the target line (24) which extends parallel to the intended line of flight of the golf ball. The unlofting line (32) indicates alternate locations for positioning a golf ball if the locations along ball position line (30) are deemed inappropriate, or if it is desired to effectively change the loft of a given club at the point of impact with the ball. In an alternate preferred form, the mat is of L-shaped configuration to leave an open space for placement of the ball to be struck.

11 Claims, 2 Drawing Sheets

GOLF PRACTICE AND TRAINING DEVICE

CROSS REFERENCE TO RELATED APPLICATIONS

This application is a continuation-in-part application of Ser. No. 000,089 for GOLF PRACTICE AND TRAINING DEVICE, filed Jan. 2, 1987, now abandoned, by Gary D. Baxstrom and assigned to the assignee of the present application.

This invention relates to golf practice aids; and more particularly relates to a novel and improved practice mat for use in learning and practicing the game of golf.

BACKGROUND AND FIELD OF THE INVENTION

The advent of the modern, one-piece golf swing has placed a great deal of emphasis on (1) posture and address position and (2) ball position with respect to the feet and shoulders. The latter in particular has been found to promote movement of the club along the proper swing path through the ball in order to impart the desired or optimum flight characteristics to the ball.

Although instruction books or instructors may describe to the student the proper address position and alignment, most students are prone to be inconsistent in repeating the proper address and alignment for each swing unless and until it is practiced correctly through constant repetition. Compounding this problem are the adjustments one must make in progressing from the short irons up to the woods both in address and ball position. The major adjustments will occur in the four basic club categories; namely, short irons from 7 through wedge, medium irons from the 4 to 6-irons, long irons including the 2 and 3-irons, and the woods, principally the driver. Perhaps the most pervasive problem to one learning the game of golf is the visual distortion in lining up sideways to a target. For instance, a player may think he has lined up square to a target only to find that he has unwittingly shifted or has turned his shoulders or feet away from a square position, or has shifted one or both of his feet out of proper alignment with respect to the ball. Moreover, certain shots in golf require special adjustments, such as, for hitting into the wind or hitting sand wedge shots out of a trap.

Many golf practice aids have been devised in the past to overcome the foregoing and other problems. For example, U.S. Pat. No. 4,355,810 to J. T. Rydeck utilizes a single curved area for the club swing, an arrow for the trajectory, a line for shoulder alignment, and outlines for the feet but does not enable adjustment or offer guidance for the proper address and ball position for different clubs. In U.S. Pat. No. 4,164,352, to J. T. O'Brien, foot outlines are used so that the golfer can move back and forth for different club positions but there are no trajectory lines or swing paths. In U.S. Pat. No. 4,023,810, to W. R. Lorang, the ball can be moved along a straight line normal to the golfer, the feet repositioned for each shot, and the swing directed along a path, but the patent fails to indicate the desired trajectory of the ball, swing paths, or realignment of the feet for different shots.

Other patents of interest are U.S. Pat. Nos. 4,248,431 to D. A. Barnes; 4,000,905 to M. J. Shirhall; 1,484,390 to Gibbs et al; and 2,707,638 to Manley. These patents either when considered alone or together fail to suggest the combination of proper foot and shoulder alignment with ball position and target-aiming arrows for the major golf club categories; nor do they disclose the use of arcuate swing path guideways and alignment guides for wedge shots and/or low trajectory golf shots.

SUMMARY OF THE INVENTION

Accordingly, it is an object of the present invention to provide for a novel and improved practice aid for use in conjunction with instruction or learning of the game of golf.

It is a further object of the present invention to incorporate all aspects of the golfing strokes into one practice aid, namely, ball position, swing path, foot and shoulder alignment; and further to provide for a practice aid as described in the form of a mat which is conformable for indoor/outdoor use.

It is a still further object of the present invention to combine the maximum instructional guidance into a single mat or unit which is portable and compact; and further to present that information in a format which is both easily comprehensible and very informative.

It is still another object of the present invention to enhance the educational benefit for the golfer with a practice aid having the maximum aesthetic appeal and ease of instruction and use.

It is an additional object of the present invention to provide for a unitary practice mat having mutually perpendicular guides for foot, shoulder, ball position and target but at the same time permitting the golfer to strike the ball off of a natural or artificial surface as desired.

In accordance with the present invention, a golf practice mat is provided for use as a means of proper alignment of feet and shoulders with respect to the position of the ball and type of club. A fixed line enables the golfer to establish his or her feet and shoulder positions. Each of four concentric, arcuate swing paths guide the club through its swing depending on the type and length of club, each swing path having arrows directed at the intended target. Sets of foot outlines define the desired foot positions for different lengths and types of clubs, as well as additional foot positions and swing paths for wedge shots. Markings in a generally straight line indicate desired ball placement for each type of club.

As one embodiment of the present invention, for example, in using a nine iron or wedge, the golfer would align his or her feet in an open stance and the club path would be more "outside/in". In using increasingly longer irons, the golfer would align his or her feet in a progressively more square position and the swing or guidepath would be progressively more "inside/out" while designating the proper swing path, ball placement and desired line of flight of the ball for each different club category.

In another preferred embodiment, the practice mat is of generally L-shaped configuration to define mutually perpendicular guides, one guide including means for establishing proper alignment of the feet and shoulders with respect to the position of the ball and type of club, and the other guide establishing alignment between the ball and target for different lengths of clubs with an open area or space formed between the perpendicular guides for placement of the ball on a natural or artificial surface.

The above and other objects, advantages and features of the present invention will become more readily understood and appreciated from a consideration of the following detailed description of a preferred embodiment of the present invention when taken together with the accompanying drawings in which:

DETAILED DESCRIPTION OF THE PREFERRED EMBODIMENT

Figure 1:
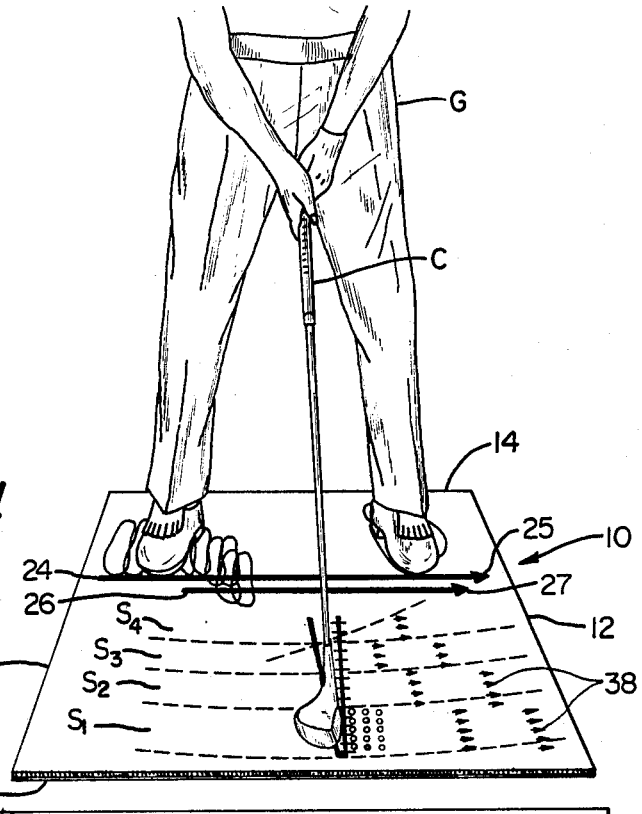
FIG. 1 is a somewhat perspective view illustrating a first preferred form of the present invention with a golfer aligned in proper position on the playing surface at an address position preliminary to striking a ball.
Figure 2:
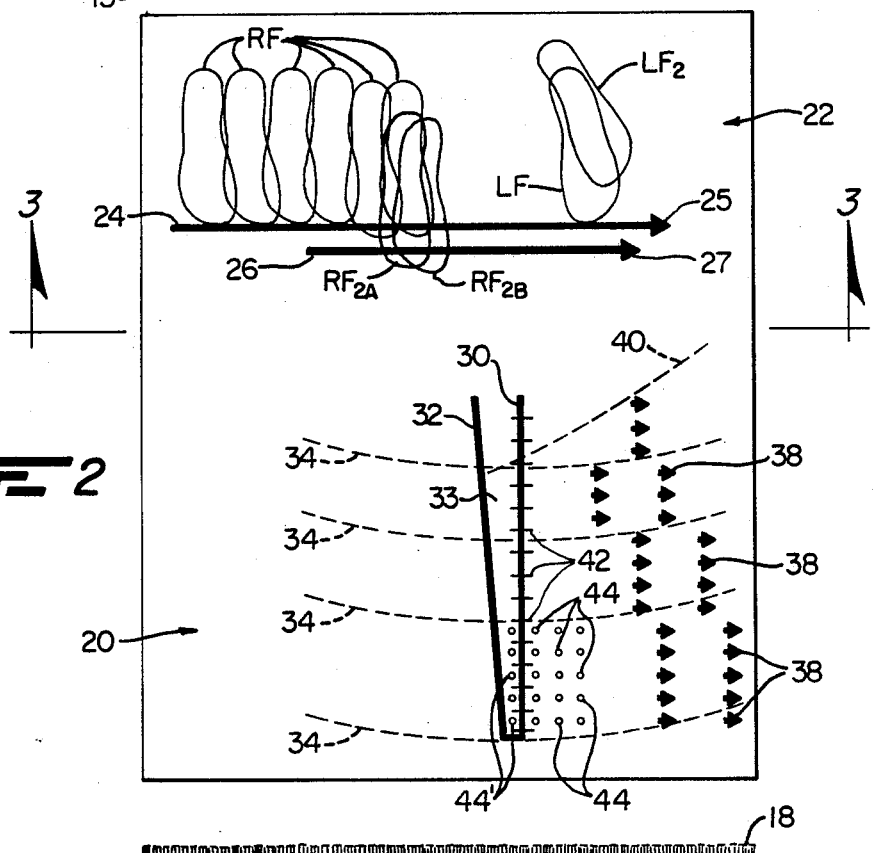
FIG. 2 is a top plan view of the preferred form of practice mat in accordance with the present invention.
Figure 3:
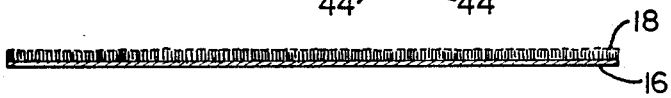
FIG. 3 is a cross-sectional view taken about lines 3—3 of FIG. 2.

Referring in detail to the drawings, there is illustrated in FIGS. 1 to 3 a preferred form of golf club practice and training device which, in accordance with the present invention, is comprised of a mat 10 of generally rectangular configuration having longer front and rear edges 11, 12 and shorter edges 14, 15. Preferably, the mat is composed of a carpet-like material with a high strength, cushioned base or carpet-like layer 16 and an upper surface 18 which defines an artificial grass surface portion. The mat may be of any desired thickness with one or more layers as described and preferably both the base 16 and upper surface 18 are sufficiently flexible that the mat can be rolled up and conveniently stored. Nevertheless, the intended use for the mat is such that it can be placed on a ground surface, for example, on a driving range or in front of a practice net; and the mat is sized to permit a right-handed golfer G to be positioned along one side or area 22 toward the edge 14 of the upper surface 18 and to swing a golf club C along an opposite side 20 toward the edge 15 of the upper surface 18, the latter side 20 referred to as the hitting area or ball-striking portion. Although the preferred form of invention is shown and described for a right-handed golfer G, it will be apparent that it is readily conformable for use by a left-handed golfer simply by reversing the position of the golfer and hitting area 20.

The one side 22 may be generally referred to as the foot alignment portion including a target line 24 having an arrow 25 at one end, extending parallel to or in the direction of the intended line of flight of the golf ball toward a target. A second line 26 having an arrow 27 is disposed in closely spaced parallel relation to the line 24 and with the arrow 27 extending in the same direction as the arrow 25. Line 26 defines a shoulder alignment marking or portion which, for example, is placed on the order of 2" in front of the foot alignment portion 24 so as to indicate proper alignment of the shoulders with respect to the desired line of flight and with respect to the positioning of the feet.

As a setting for a description of the preferred form of invention, golf clubs can be generally divided into four main categories or types of clubs: (1) the woods, (2) the longer irons ranging from the 1 to 3-irons, (3) the medium irons ranging from the 4 to 6-irons, and (4) the shorter irons ranging from the 7-iron to the wedge.

With this in mind, a series of foot position indicia are provided in direct association with the target line 24, the indicia comprised of a set of two partially overlapping footprints designated at LF and $LF_2$ designating two different positions for placement of the left foot of a right-handed golfer and progressing in a forward direction toward the arrow end of the target line 24 such that the toe of footprint LF touches the target line and footprint $LF_2$ is fanned outwardly and slightly away from the target line. In turn, footprints for the right foot include correspondingly designated footprints $RF_{2A}$ and $RF_{2B}$ color-coded to be associated with the footprint $LF_2$ for the left foot, and a series of six footprints collectively designated at RF. The footprints RF represent alternate positions for the right foot when the left foot is placed over the footprint LF. The right footprint indicia $RF_{2A}$ and $RF_{2B}$ are positioned to overlap both the target line 24 and shoulder line 26; however, the right footprints RF are offset rearwardly but essentially square to the line of flight with the toe portions either overlapping or touching the target line 24. In succession, the right footprints RF are progressively spread away from the left footprint RF to establish a progressively wider stance. It will be evident that the footprint indicia $LF_2$ and $RF_{2A}$ or $RF_{2B}$ for the left and right feet, respectively, would establish a slightly open stance with the feet positioned relatively close to one another. However, the footprint LF in combination with one of the footprints RF represent more of a square stance for the golfer G at address position.

A ball position line 30 extends perpendicular to and away from the target line 24 and shoulder line 26 so as to traverse substantially the entire hitting area 20. A second line 32 diverges at a low gradual angle from its intersection with the distal end of the ball position line 30 toward the target line 24 so as to define an "unlofting area" designated at 33, the function of which is hereinafter described in more detail.

A plurality of arcuate guidelines, represented in dotted form at 34, are concentrically arranged in spaced apart relation to one another symmetrically across the ball position line 30. On the right side of the line 30, the guidelines 34 define "approach" guidelines to represent the swing path through which a golf club is to be taken in the backswing away from the ball and returned in approaching the ball in the downswing. On the left side of the line 30, the guidelines 34 designate the swing path to be followed by the golf club in the follow through. Preferably the angle of approach of the guidelines 34 with respect to the ball position line 30 is the same as the angle of departure or follow through of the guidelines 34 forwardly of the ball position line. As illustrated, each adjacent pair of guidelines 34 define swing paths $S_1$, $S_2$, $S_3$ and $S_4$ for the four different categories of golf clubs as described. Thus, for example, the swing path $S_1$ represents the outermost swing path for the woods and particularly the driver position; $S_2$ is the swing path for the longer irons; $S_3$ is for the medium irons; and $S_4$ is for the short irons. In order to serve as a further guide for the learning golfer, the swing paths are color-coded or otherwise coded such as by numerical coding to match up with the coding of the different foot positions. Arrows 38 at the leading ends of the swing paths $S_1$–$S_4$ designate the intended line of flight of the ball.

Diagonal guideline 40 defines a swing path which runs at an approximate angle of 30° to the ball position line 30 as a guide area for shorter wedge shots and specifically is aligned for use with the foot positions $LF_2$ and $RF_{2B}$. In other words, this will trail the golfer to assume an open stance and to swing the club along the diagonal swing line represented at 40 while maintaining the blade of the club parallel to arrows 38.

A plurality of ball placement markers 42 intersect the ball position line 30 at spaced intervals along its length. The ball placement markers are relatively short straight lines and may be color-coded to correspond with the foot position indicia LF and RF. The ball placement markers 42 are spaced approximately a ball diameter apart from one another and are intended to provide a more accurate and consistent means of positioning a ball for a specific golf club category or grouping. For example, for the medium irons there is a slight gradation in length in progressing from the 6-iron to the 4-iron so that the ball placement for the 6-iron would be by that marker within the area of the swing path $S_3$ nearest to the target line or golfer. The next adjacent ball marker 42 away from the target line would represent the desired placement for the 5-iron, and the outermost marker 42 the desired marker for the 4-iron. It should be understood that the ball placement markers for a given club will vary with the individual arm length of the golfer and club length for a given set of clubs but again will provide a more consistent means of placing the ball for each club.

Tee position markers 44 are provided in the area of the swing path $S_1$ just forwardly of the ball position line 30 to designate different selected positions for placement of a tee according to the length and the type of wood. Most desirably, the markers 44 are in the form of openings extending through the entire thickness of the golf mat to permit placement or insertion of a tee through the opening into the ground. The tee markers 44 facilitate consistent placement of the ball and as shown there are a series of three columns of markers 44, with five markers in each column in front of the ball position line 30. A fourth column 44' is disposed between the line 30 and the unlofting line 32 for a purpose to be described.

It will be evident form the foregoing that the preferred form of golf mat is intended to be used by a right-handed adult golfer and would be reversed for a left-handed golfer. Moreover, different sizes would be required for junior, men and women golfers as well as for persons who stand a greater distance from the ball either because of their stature, length of club, or personal preference.

The mat 10 is intended to develop upper body and foot alignment to the target as well as the proper ball position in playing various types of golf shots during a golf round. Thus, as noted, the ball position line 30 is positioned essentially in the center of the stance so as to encourage placement of the ball at the proper distance from the left heel. One exception of course is for the longer shots and wood shots where the markers 44 will encourage placement more nearly opposite to the left heel. Proper correlation of the foot position with the different swing paths and ball placement markers via color or numerical coding will enable the golfer to more consistently set up to the ball for each shot or, in other words, to establish the proper address, stance and alignment. Once these are established, it is much easier for the instructor and the golfer as well to concentrate on other parts of the game, such as, the proper grip, swing plane and shoulder and hip turn. The mat serves as a valuable training and practice aid in coordinating the position of the feet and shoulders with the proper position of the ball and swing path into the ball for different types and lengths of clubs. For example, as the golfer practices with the longer clubs or woods down to the shorter clubs, the color-coordinated foot position indicia instruction in gradually reducing the width of the feet by bringing the right foot closer to the left foot in gradual amounts as shorter clubs are used, while at the same time progressively changing from a closed stance to a square or open stance with respect to the ball. At the same time the toe angle changes in gradual amounts between a somewhat fanned out position of the right and left feet to a square position of the right foot, as indicated at $RF_{2A}$, and an increasingly fanned out and open position of the left foot as at $LF_2$ to promote a more descending club head path towards the ball as shorter clubs are used.

The training mat 10 accommodates two different schools of thought in the teaching of golf and permits either to be followed and adopted in its use: The first is that the ball should be placed in the same position relative to the heel of the left foot for a right-handed golfer and progressing from the driver down to the wedge or, in other words, should always be played on the ball position line 30 and inside of the left heel; and the second is that, as the shorter clubs are used, the ball should be moved more to the right or back toward the right foot and therefore positioned somewhat to the right of the ball position line along the secondary line 32 for progressively shorter clubs. At the same time, the secondary line 32 is applicable to both schools in training the play of a low trajectory shot for use in windy conditions by moving the ball increasingly back of the ball position line 30 as shorter clubs are used. For this reason, the line 32 is designated as the "unlofting line" in that it reduces the loft of a given club at the point of impact with the ball and thus promote a lower trajectory shot. On the other hand, the tee markers 44 afford a means of training the golfer in positioning the ball slightly in front of the ball position line 30 in playing the longer wood shots off of the tee. The markers are arranged in a plurality of well-defined rows proressing forwardly or to the left away from the ball position line to take into account variations in club length of the different woods as well as individual variations in arm length and the posture of each golfer. The markers in each row would accommodate individual variations in the length of each numbered wood and swing arc of the individual golfer. Most important for the individual golfer is to promote consistent ball positioning and foot alignment for each shot and to encourage the student to repeat the proper technique in each practice session. The use of specific markers for the longer, more difficult shots have been found to be the best way to emphasize to the student the importance of consistent and correct ball positioning for each club and to make the golfer realize that there is considerably less margin for error in consistent striking of the woods than for the shorter clubs. Similarly, the individual ball markers 42 provided within each swing path $S_2$–$S_4$ account for variations in club length within each golf club category as well as individual variations in swing arc for each golfer. Preferably each ball marker 42 takes the form of a short perpendicular line intersecting the ball position line 30 and appropriately coded such as by color-coding to correspond to the proper foot position.

Correspondingly, the guidelines 34 define the proper swing path for the takeaway or beginning of the back swing to encourage the student to take the club back in the proper swing plane as well as to return the club through the proper swing path in striking the ball as well as to promote the correct follow-through of the golf club in each swing path. As noted earlier, in the preferred form, color-coding is preferably employed, specifically by using the same color to define the guidelines for each marker 42 as the color employed for each set of corresponding footprints LF and RF. It will be evident however, that other coding may be employed such as numerals or letters to assure that the student properly combines the correct foot position with a given ball marker. This is helpful, for example, with respect to the swing path as delineated by the diagonal guideline 40, which is aligned to correspond to the footprints $LF_2$ and $RF_{2B}$ so that the golfer will understand that it is necessary to adopt the proper open stance in swinging along the line 40. Nevertheless, in setting up to the shot, the face or leading edge of the club head should be aligned parallel to the ball position line 30 so as to open up the face and produce a high or loft shot. When the swing is made along the recommended swing path, a high, soft, short shot is generally the result and is excellent practice for shots to be made out of the sand, tight lies around the green or going over an obstacle to the green with very little run on the ball. Again, the actual line of flight of the ball should be in a direction parallel to the arrows 38 along the swing path 34.

Further, in the preferred form of invention, the various markings consisting of the target line 24, shoulder line 26, ball position line 30 and unlofting line 32 are somewhat broader or thicker than the guidelines 34, 35 as well as the footprint indicia LF and RF. All such markings are preferably formed on the upper surface 18 by imprinting or embossing with a permanent dye or ink into the surface so as to be easily visualized by the golfer but not subject to fading or removal after repeated use and impact by the golf club. As a golfer progresses in ability, various advanced forms of training mats 10 may be adopted from the basic principle of the mat as described, such as, by removal of the ball placement markers 42, guidelines 34 and 40 or, in the alternative, by removal of the arrows 38 at the ends of the respective swing paths. The unlofting line 32 is a valuable training aid in teaching the golfer to move the ball back in his or her stance in executing lower trajectory shots. The divergency or slope of the line 32 encourages the golfer to position the ball increasingly farther back in the stance in progressing from the longer to the shorter irons. The line 32 can be used as a training aid to develop a draw or hook by playing the ball farther back toward the right foot.

DESCRIPTION OF ANOTHER PREFERRED EMBODIMENT

Figure 4:
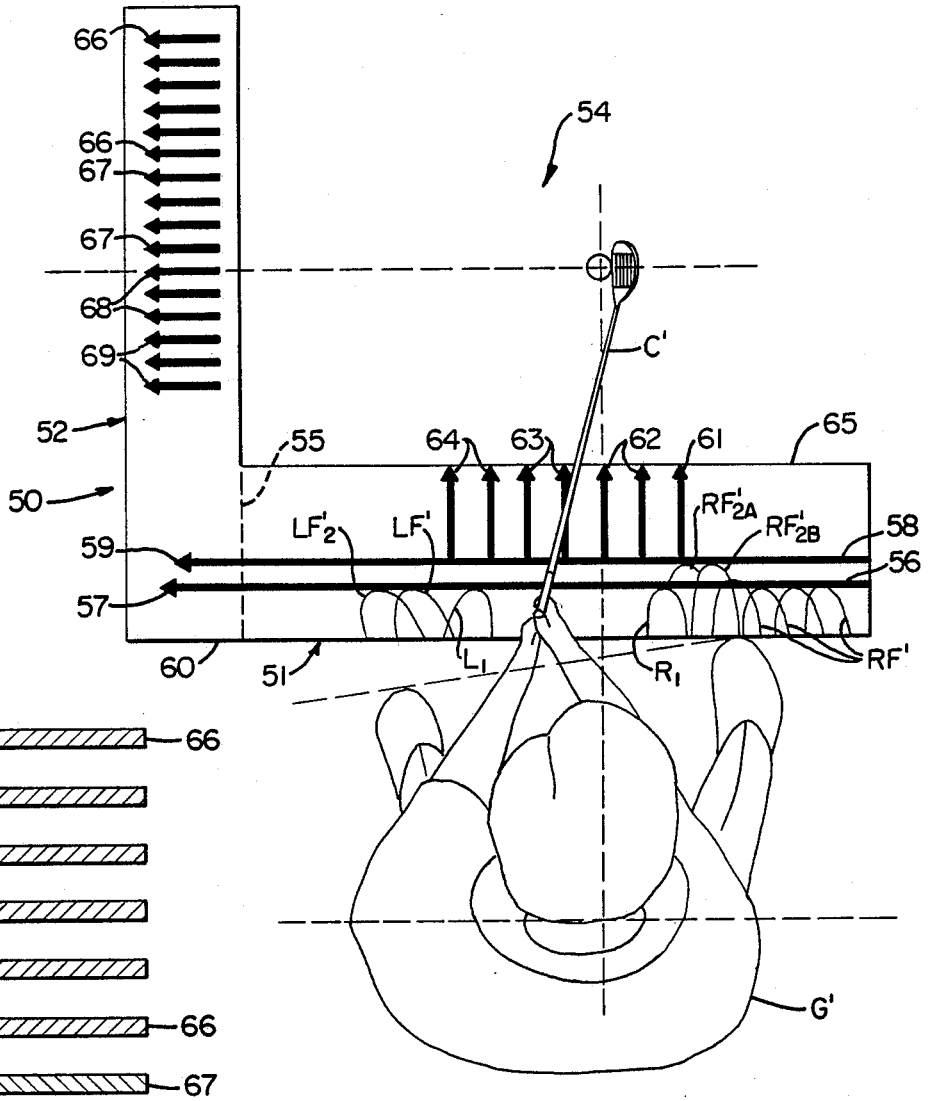
FIG. 4 is a top plan view of a second preferred form of practice mat illustrating a typical relationship formed between the golfer, club and mat at an address position.
Figure 5:
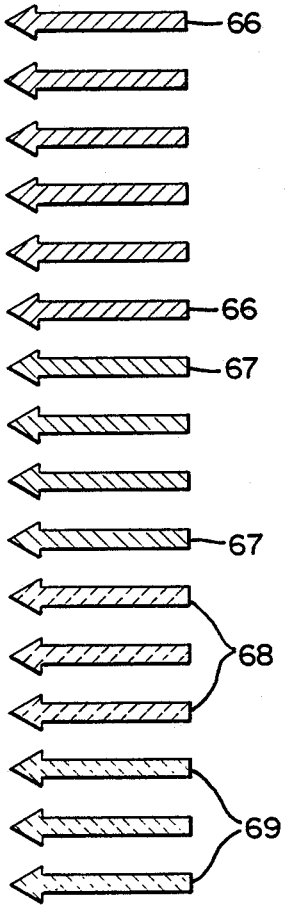
FIGS. 5 and 6 are enlarged plan views illustrating in more detail arrowed line portions of the mat shown in FIG. 4.

The basic principles of the form of mat illustrated in FIGS. 1 to 3 are incorporated into the alternate form illustrated in FIGS. 4 and 5 wherein a mat 50 is of generally L-shaped configuration and is made up of two mutually perpendicular mat sections or guides 51 and 52 so as to leave an open swing path area or space 54 behind the section 52 along which the golf club as generally indicated at C' may be swung by golfer G'. The composition and thickness of the mat may correspond to that described with respect to the form of invention shown in FIGS. 1 to 3, although it will be evident that various materials may be used in constructing the mat, since it is not contemplated that the golfer actually stand on the mat in swinging the club but rather will employ it purely as a guide or practice aid. Moreover, as shown, the mat 50 is formed in two separate sections 51 and 52 which are assembled or joined together along the line of intersection, as shown dotted at 55, by a suitable splice or adhesive therebetween. It will be apparent however that the mat sections 51 and 52 may be integrally united in the process of manufacture.

The mat section 51 is in the form of an elongated rectangular strip having a foot position line 56 with an arrow 57 at one end, the line 56 extending in the direction of the intended line of flight of the golf ball toward a target for a right-handed golfer. A shoulder alignment line 58 is disposed in closely spaced parallel relation to the line 56 and includes an arrow 59 which extends in the direction of the target. As in the form of FIGS. 1 to 3, the line 58 is placed in front of the foot position line 56 for proper alignment of the shoulders with respect to the intended positioning of the feet and line of flight of the ball.

In a manner similar to that of FIGS. 1 to 3, two partially overlapping footprints LF' and $LF_2'$ designate two different positions for placement of a left foot of a right-handed golfer progressively in a forward direction toward the arrow end of the foot position line 56, the toe of footprint LF' touching the line 56 and that of $LF_2'$ fanned outwardly and slightly away from the line 56. Footprints for the right foot include correspondingly designated footprints $RF_{2A}'$ and $RF_{2B}'$ color-coded to be associated with the footprint $LF_2'$ of the left foot, and a series of four footprints collectively designated at RF'. The footprints RF' again represent alternate positions for the right foot when the left foot is aligned with the position LF'. In the form of FIG. 4, indicia $RF_{2A}'$ and $RF_{2B}'$ overlap the target line 56 only. In turn, the footprints RF' are offset rearwardly but essentially square to the line of flight with the toe portions either overlapping or withdrawn slightly from the line 56. In succession, the right footprints RF' are once again progressively spread rearwardly from the left footprint RF' in establishing a progressively wider stance. It will be noted in FIG. 4 that only a portion of a footprint is designated along the limited width of the mat between the line 56 and innermost edge 60 so that the golfer may use the footprint indicia as guides for proper width or spacing between the feet.

As an aid for learning proper alignment to the ball, preliminary foot position indicia are included at $L_1$ and $R_1$ which designate the preparatory position of the feet with respect to the ball preliminary to spreading them to the desired foot positions for a given shot. Specifically, this is an aid in establishing the desired pre-shot routine in aligning one's body first to the ball, then spreading the feet to the desired foot positions, left and right, according to the club selected.

Figure 6:
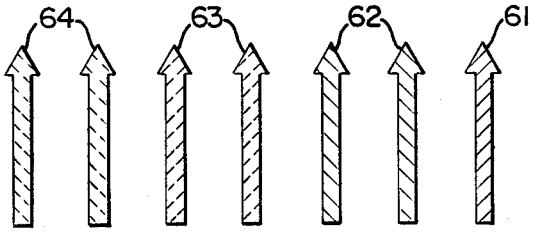

A series of closely spaced arrowed ball position lines 61, 62, 63 and 64, each provided with an arrow at one end, extend perpendicular to the shoulder position line 58 and in a direction toward the outer edge 65 of the mat 51. The ball position lines 61–64 are intended to serve as guides for proper positioning of the ball for different shots. Most desirably, the lines are color-coded in a manner to be described and shown in FIG. 6 to designate preferred ball positions ranging from a far left position when hitting a wood shot from a tee to a far right position for hitting short, middle and long irons depending on the stance or spacing between the feet.

The mat section 52 similarly is an elongated strip but somewhat narrower than the section 51 and is provided with a series of equally spaced target-aiming arrowed lines 66, 67, 68 and 69. As best seen from FIG. 5, the arrowed lines 66–69 are color-coded to match the color coding of the arrowed lines 61 to 64 with the outermost line 66 serving as a guide for proper alignment of the ball when the longest clubs are used ranging from the 5-wood to the driver; the arrowed lines 67 are intended for alignment of the ball for striking with one of the long irons ranging from the 2-iron to 3-iron; the arrowed lines 68 are provided for alignment of the ball for the middle irons ranging from the 4-iron to 6-iron; and the lines 69 intended to establish alignment for the short irons ranging from the 7-iron through the wedge.

In use, the mat as described may be placed on the ground or artificial surface from which a ball may be struck. The ball is placed at an imaginary point of intersection between a ball position line 61 to 64 and target-aiming line 66 to 69 depending upon the golf club used. The feet are aligned with the foot indicia $L_1$ and $R_1$ before spreading them into alignment with corresponding pairs of foot position indicia as described in relation to FIGS. 1 to 3. However, a distinction will be noted in that the feet may be positioned alongside the inner edge of the mat section 51 and not actually placed on the mat.

It is therefore to be understood that various modifications and changes may be made in the specific construction and arrangement of lines, material composition and indicia as described without departing from the spirit and scope of the present invention as defined by the appended claims.

I claim:

1. In a golf swing training and practice aid wherein a mat is adapted to be placed on a ground surface, said mat having an upper surface including a foot alignment portion, a target line extending parallel to the intended line of flight of the golf ball, and at least one ball position line extending perpendicular to and away from said target line across said upper surface, the improvement comprising:

a series of foot position indicia on said upper surface portion and in proximity to said target line designating a series of different foot positions for placement of each of the left and right feet of a player in accordance with the length and type of golf club being swung;

a shoulder alignment line disposed in closely spaced parallel relation to and in front of said target line; and a plurality of target-aiming lines spaced along an end of said mat nearest the target and extending parallel to said target line for indicating the intended path of flight of a ball toward the target when placed in alignment with one of said lines.

2. In a golf swing and training practice aid according to claim 1, said mat having two mutually perpendicular mat sections defining a mat of L-shaped configuration, said target line extending along one of said mat sections and said target-aiming lines extending along another of said mat sections with an open space rearwardly of said other of said mat sections for placement of a golf ball to be struck in alignment with but spaced rearwardly of one of said target-aiming lines.

3. In a golf swing training and practice aid according to claim 2, said one mat section having a plurality of ball position lines extending perpendicular to said target line, said ball position lines being color-coded to correspond with color designations of said target-aiming lines.

4. In a golf swing training and practice aid according to claim 1, said left and right foot position indicia intersecting an inner edge of said mat, and a plurality of ball position lines extending in predetermined spaced relation to one another and to said foot position indicia, said ball position lines being color-coded to correspond to color coding of said target-aiming lines for placement of a ball to be struck at imaginary intersections of corresponding colors of said ball position lines and said target-aiming lines.

5. In a golf swing training and practice aid according to claim 1, said foot position indicia including a pair of indicia in closely spaced parallel relation to one another designating the preparatory position for the feet of a golfer in alignment with a ball to be struck and as a preliminary to selecting the proper spacing for each shot.

6. In a golf swing training and practice aid wherein a mat is adapted to be placed on a ground surface and from which a golf ball can be struck, a foot alignment portion includes a target line (24) extending parallel to the intended line of flight of the golf ball, and a ball position line (30) extends substantially perpendicular to and away from said target line, the improvement comprising:

a shoulder alignment line (26) disposed in closely spaced parallel relation to and in front of said target line;

a plurality of left and right foot position indicia on said upper surface portion facing and in proximity to both said target line (24) and shoulder line (26), said indicia designating different foot positions for placement of each of the front and rear feet of the player in accordance with the length and type of golf club being swung;

a plurality of arcuate swing path guidelines spaced from said target line along said ball-striking surface portion of said mat, said guidelines defining the swing paths through which the different lengths and types of golf clubs are to be swung by the golfer to strike a golf ball when placed in proximity to said ball position line; and a plurality of arrows (38) spaced along the end of said mat nearest to the target and indicating the intended path of flight of said ball toward the target.

7. In a golf swing training and practice aid according to claim 6, further characterized by each adjacent pair of guidelines defining an arcuate swing path therebetween, an innermost of said adjacent pair of guidelines defining the swing path for the shorter irons and an outermost of said adjacent pair of guidelines defining the swing path for the woods, and a plurality of closely spaced golf tee-receiving markers disposed in proximity to said ball position line between said outermost of said adjacent pair of guidelines between said outermost of said adjacent pair of guidelines.

8. In a golf swing training and practice aid according to claim 6, there being an unlofting ball position line (32) diverging rearwardly at a low angle away from said ball position line across said guidelines toward said right foot position indicia.

9. In a golf swing training and practice aid wherein a mat (10) is adapted to be placed on a ground surface, the mat (10) having an upper surface (18) including an artificial surface portion for placement of a golf ball thereon and from which a golf ball can be struck, a foot alignment portion (22) including a target line (24) extending parallel to the intended line of flight of the golf ball, and a first ball position line (30) extending perpendicular to and away from said target line across said artificial grass surface portion, the improvement comprising:

a series of foot position indicia (LF and RF) on said upper surface portion and in proximity to said target line designating a series of different foot positions for Impalement of each of the front and rear feet of the player in accordance with the length and type of golf club being swung; and a second ball position line (32) extending in spaced relation to said first ball position line (30) in a direction away from said target line (24) and converging toward said first ball position line (30), a plurality of guidelines (34) extending away from said target line (24) and disposed symmetrically with respect to said ball position line (30) on opposite sides thereof, said guidelines (34) representing the swing path through which the different lengths and types of golf clubs are to be swung by the golfer to strike a golf ball placed in proximity to said ball position line (30), a series of arrows (38) placed in predetermined relation to said guidelines indicating the intended path of flight of the ball toward the target for each of said guidelines (34), adjacent pairs of guidelines (34) defining arcuate swing paths therebetween, an innermost of said adjacent pair of guidelines defining the swing path for the shorter irons and an outermost of said adjacent pair of guidelines (34) defining the swing path for woods, and a plurality of closely spaced tee markers (44) disposed in proximity to said ball position line in alignment with said outermost adjacent pair of said guidelines, each of said tee markers adapted for placement of a tee.

10. In a golf swing training and practice aid according to claim 9, including ball position markers (42) within each said swing path defined by said guidelines (34) to designate the desired placement of a golf ball.

11. In a golf swing training and practice aid according to claim 9, including a shoulder alignment line (26) disposed in closely spaced parallel relation to said target line (24), and a guideline (40) extending diagonally with respect to said ball position line (30).

* * * * *

UNITED STATES PATENT AND TRADEMARK OFFICE

CERTIFICATE OF CORRECTION

PATENT NO. : 4,915,387

DATED : 10 April, 1990

INVENTOR(S) : Baxstrom, Gary D.

It is certified that error appears in the above-identified patent and that said Letters Patent is hereby corrected as shown below:

| | | |
|---|---|---|
| Column 5 | Line 1 | cancel "trail" and substitute -- train -- |
| Column 6 | Line 5 | cancel "instruction" and substitute -- instruct him -- |
| Claim 9<br>Column 11 | Line 10 | cancel "Impalement" and substitute -- for placement -- |

Signed and Sealed this

Ninth Day of July, 1991

*Attest:*

HARRY F. MANBECK, JR.

*Attesting Officer*

*Commissioner of Patents and Trademarks*